United States Patent [19]

Walker

[11] Patent Number: 4,722,148

[45] Date of Patent: Feb. 2, 1988

[54] FIREARM

[75] Inventor: Hylton R. Walker, Pinetown, South Africa

[73] Assignee: Aserma Manufacturing A Division of O.M.C., Aserma (Proprietary) Limited, New Germany, South Africa

[21] Appl. No.: 874,586

[22] Filed: Jun. 16, 1986

[30] Foreign Application Priority Data

Jun. 14, 1985 [ZA] South Africa ..... 85/4517

[51] Int. Cl.[4] ..... F42C 9/00; F42C 19/00

[52] U.S. Cl. ..... 42/69.01; 42/40

[58] Field of Search ..... 42/1.14, 1.08, 69.01, 42/1.15, 16, 40.01, 40.02, 40.03

[56] References Cited

U.S. PATENT DOCUMENTS

| | | | |
|---|---|---|---|
| 2,195,711 | 4/1940 | Hutchison | 42/1.08 |
| 3,260,009 | 7/1966 | Hillberg | 42/69.01 |
| 3,352,046 | 11/1967 | Warner et al. | 42/69.01 X |
| 3,545,116 | 12/1970 | Babington | 42/1.08 |
| 4,400,900 | 8/1983 | Hillberg et al. | 42/69.01 |
| 4,407,085 | 10/1983 | Hillberg et al. | 42/69.01 |
| 4,416,078 | 11/1983 | Hillberg | 42/69.01 |
| 4,424,638 | 1/1984 | Hillberg | 42/69.01 |
| 4,489,515 | 12/1984 | Numbers | 42/69.01 X |

FOREIGN PATENT DOCUMENTS

| | | |
|---|---|---|
| 607614 | 3/1926 | France . |
| 190161 | 4/1937 | Switzerland . |

*Primary Examiner*—David H. Brown

*Attorney, Agent, or Firm*—Ladas & Parry

[57] ABSTRACT

A firearm has a plurality of parallel barrels arranged uniformly circumferentially about a center axis. A hammer is translational from a cocked position to a fire position along said center axis. It has a firing pin offset from the center axis in correspondence to the spacing of the barrels from the center axis. The hammer is pivotal about said center axis during cocking to advance the firing pin from an aligned position in respect of one barrel to an aligned position in respect of a succeeding barrel. The firearm comprises a trigger guided for translation rearwardly from a rest position. A sear, connected to the trigger via a ramp formation, is arranged, on depression of the trigger, to engage the hammer to cock it. Progressive depression of the trigger progressively displaces the sear via the ramp formation to a release position in which the hammer is released to translate from its cocked position to its fire position under resilient bias.

9 Claims, 6 Drawing Figures

FIREARM

This invention relates to a firearm, to a firing mechanism for a firearm, and to a method of operating a firearm.

In accordance with the invention, there is provided a firearm including a plurality of barrels circumferentially spaced about a centre axis, axes of the barrels being substantially parallel to one another and to said centre axis, and a firing mechanism having a trigger;

a hammer mounted for translation in forward/rearward directions between a cocked position and a fire position and for pivoting about a hammer pivot axis co-axial with said centre axis, a firing pin fast with the hammer and transversely spaced from the hammer pivot axis in correspondence with the spacing of the barrels from the centre axis, cocking means for cocking and firing the hammer and being operatively connected to the trigger, and pivot means adapted to pivot the hammer about said hammer pivot axis between shots to advance the firing pin from one barrel to another.

The hammer may be generally cylindrical and of composite construction including a drum and a base mounting the drum for rotation. The base may include a spindle defining the hammer axis and mounting the drum. The firearm may define a corresponding cylindrical hammer passage having an axis co-axial with the centre axis and being adapted to locate the hammer to allow it to slide longitudinally along, and to rotate about, the centre axis.

To limit the spacing of the firing pin from the pivot axis of the hammer, the firearm may be adapted for use with rim fire cartridges, the firing pin being arranged, in use, to strike the cartridges on points on their rims intermediate the centre axis and the respective barrel axes. In other embodiments, the firearm may be adapted for use with centre fire cartridges having centre primers.

The hammer may resiliently be biassed to its fire position and the cocking means may include a sear adapted, in use, operatively to connect the hammer to the trigger to effect cocking of the hammer in response to depression of the trigger, and to break said connection when the trigger is depressed beyond a predetermined limit to allow the hammer to be displaced to its fire position under its bias.

The cocking means may include a ramp formation connecting the sear to the trigger, the ramp formation being arranged, on depression of the trigger in use, to displace the sear progressively toward a release position in which interconnection is broken. The sear may be guided for translation in a direction transverse to the centre axis, and the trigger may be guided for translation parallel to the centre axis.

The pivot means may comprise obliquely extending shoulder means and complemental abutment means arranged to be in sliding abutment with the shoulder means, one of the shoulder means and the abutment means being movable with the hammer, the other being stationary with a frame of the firearm. The shoulder means may include a plurality of obliquely extending shoulders on the hammer, the shoulders being circumferentially spaced around the hammer, each shoulder being associated with a barrel, the abutment means including an abutment formation fast with a frame of the firearm. The shoulders may be defined by grooves in the hammer, the abutment formation being in the form of a male formation slidingly receivable in turn in the respective grooves. The grooves may be interconnected, and may define steps at intersections thereof to guide the male formation in one direction only, the male formation being biassed to follow the steps. The steps may be in bottoms of the grooves, at least some of the bottoms sloping between steps.

The invention extends to a firing mechanism suitable for use with a firearm and including a trigger which is guided for translation from a rest position rearwardly;

a hammer which is guided for translation from a cocked position to a fire position, the hammer being resiliently biassed to its fire position;

cocking means including a sear which is arranged to connect the hammer to the trigger, in use, to effect cocking of the hammer in response to depression of the trigger, and to break said connection when the trigger is depressed beyond a predetermined limit to allow the hammer to translate to its fire position under its bias.

The cocking means may include a ramp formation connecting the sear to the trigger, the ramp formation being arranged, on depression of the trigger, in use, to displace the sear progressively toward a release position in which the connection between the hammer and the trigger is broken.

The sear may be guided for translation in a direction transverse to the centre axis, and the trigger may be guided for translation parallel to the centre axis.

The invention extends yet further to a method of operating a firearm having a plurality of barrels circumferentially spaced about a centre axis, the axes of which are substantially parallel to one another and to said centre axis, the method including cyclically, translationally, cocking and firing a hammer which is translational along the centre axis and mounting a firing pin positioned off-centre in accordance with the spacing of the barrels from the centre axis; and pivoting the hammer about the centre axis in sympathy with the cocking and firing, to advance the firing pin from one barrel to another between shots.

When the hammer is resiliently biassed to its fire position, and when the cocking means includes a sear connecting the hammer to the trigger, the method may include cocking the hammer against its bias by depressing the trigger to displace the sear to engage the hammer, and progressively displacing the sear out of engagement with the hammer until it releases the hammer to allow it to be propelled under its bias to its fire position.

The invention is now described by way of example with reference to the accompanying diagrammatic drawings. In the drawings, FIG. 1 shows, in three dimensional view from in front and from one side, a firearm in accordance with the invention;

Figure 1:
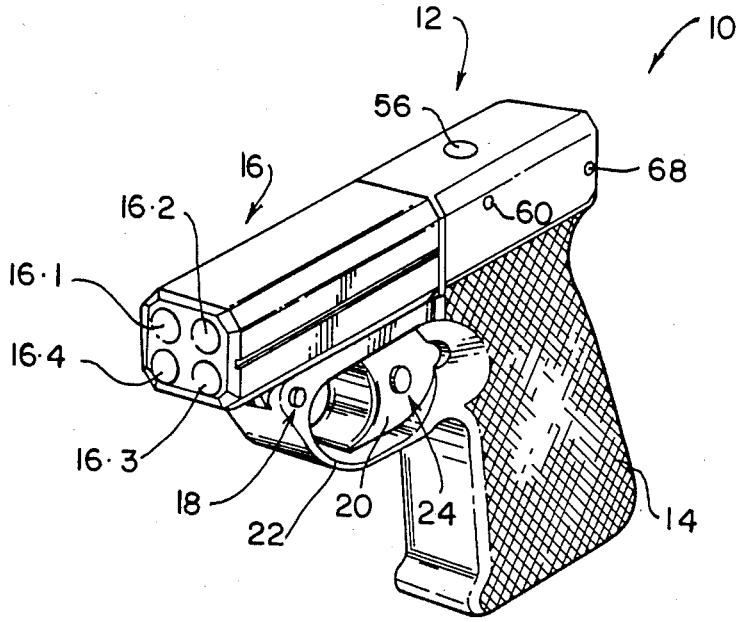
Figure 2:
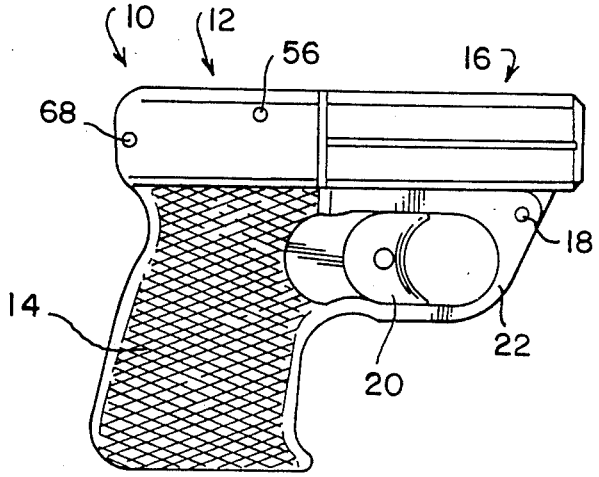
FIG. 2 shows a side view from another side of the firearm of FIG. 1.

With reference to FIGS. 1 and 2 of the drawings, a firearm in accordance with the invention is generally in the form of a pistol 10 and is more specifically a derringer.

The pistol 10 includes a frame generally indicated at 12, a hand grip 14 and a composite barrel 16 comprising four barrels 16.1, 16.2, 16.3 and 16.4. The barrels will herein collectively be referred to as the barrels 16. The composite barrel 16 is pivotal with respect to the frame 12 about a transverse, decumbent pivot pin 18 disposed toward the front of the pistol 10. Thus, the rear of the composite barrel 16 is pivotal upwardly to render it accessible. The pistol 10 further includes a trigger 20 guarded by means of a trigger guard 22 and a safety catch 24 mounted in the trigger 20.

Figure 3:
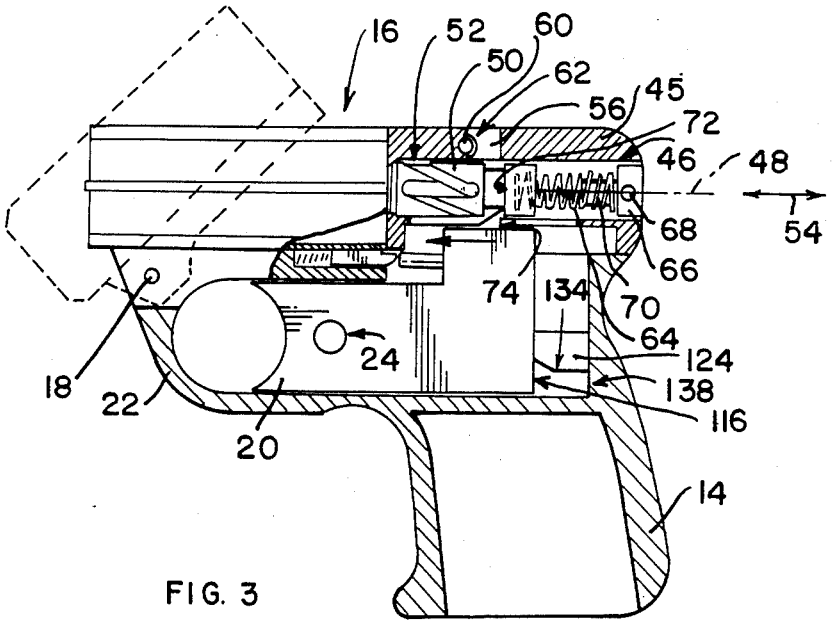
FIG. 3 shows, in sectional side view, the firearm of FIG. 1.

With reference also to FIG. 3, the barrels 16 have axes which are parallel and which are, when seen in longtitudinal direction, in orthogonal relationship with one another, more specifically at the corners of an imaginary square. Thus, the barrels 16 are arranged in circumferentially spaced relationship about a centre axis longitudinal with and equidistant from the barrel axes. The centre axis is indicated at 48.

Figure 4:
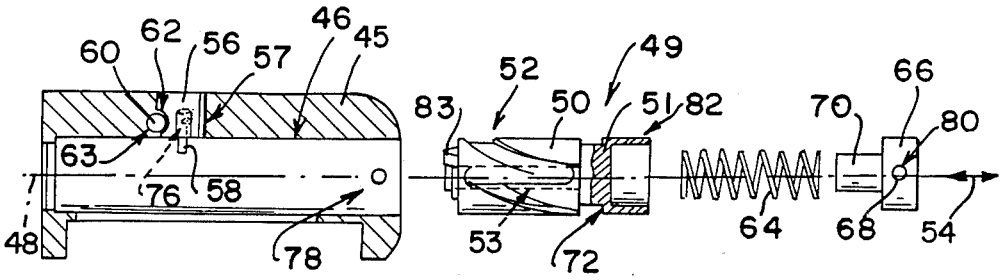
FIG. 4 shows, in sectional side view to a larger scale a portion of the frame and a hammer of the firearm of FIG. 1.

With reference also to FIG. 4, in the frame 12, immediately rearward of the composite barrel 16, there is accommodated a breech 45 defining a cylindrical through passage 46 arranged to be co-axial with the centre axis 48 when the breech is assembled. The passage 46 accommodates a substantially cylindrical hammer 49. The hammer 49 is slidably located co-axially within the passage 46 to allow translation in both directions along the centre axis 48 as indicated at 54. The hammer 49 is a composite hammer including a base 51 having a co-axial spindle 53 co-extensive with the hammer axis and mounting a drum 50 for rotation. When the hammer 49 and the breech 45 are assembled in the frame 12, the drum 50 is rotatable about the centre axis 48. The drum 50 has, in its periphery, a plurality of grooves 52 which will be described in more detail with reference to FIG. 5.

The hammer 49 is biassed forward i.e. toward the composite barrel 16, by means of biassing means including a coil spring 64 mounted for compression between the movable base 51 and a stationary mounting base 66 which is retained by means of a retaining pin 68 in the breech 45. On either side of the passage 46, through the breech 45, there are provided a pair of aligned retaining holes 78. A complemental diametrical hole 80 is provided through the base 66. When in position, the base 66 is manipulated to bring the diametrical hole 80 into register with the holes 78 in the frame. The retaining pin 68 is then passed through the holes.

The base 66 has a male projection 70 arranged, when assembled, to be co-axial with the centre axis 48 and to project toward the composite barrel 16. The coil spring 64 is received over the male projection 70. To locate the coil spring 64 in the movable base 51, a socket 82 is provided in its rear.

The drum 50 mounts, at its fore end, a firing pin 83 projecting forwardly. The firing pin 83 is laterally spaced from the axis of the hammer, and thus, when assembled, laterally spaced from the centre axis 48 a distance corresponding to the spacing of the barrels 16 from the centre axis 48.

In use, the hammer is cocked by displacing it rearwardly against the bias of the coil spring 64. The firing pin 83 is indexed with a barrel 16. The hammer is then released to be propelled forward under the bias of the coil spring 64. The hammer 49 fires a cartridge from the barrel with which it was indexed.

When the hammer 49 is cocked for a following shot, the drum 50 is pivoted through 90° to align the firing pin 83 with a succeeding barrel. This procedure is cyclically repeated.

The grooves 52, in co-operation with guide means are adapted to guide and to pivot the drum as stated above. The guide means comprises a guide member 56 accommodated in a guide member passage 57 in the breech 45. The passage 57 is provided directly above and perpendicular to the passage 46. The guide member 56 has a semi-circular recess 62 transversely across one side. A complemental semi-cylindrical recess 63 is provided in the breech 45 bordering the passage 57. The guide member 56 is manipulated in relation to the breech 45 until the semi-cylindrical recesses 62 and 63 are opposite each other to form a cylindrical passage. A retaining pin 60 is passed through the passage to retain the guide member in position within the breech.

A male guide projection 58 is provided in a socket within the guide member 56. The male projection 58 projects into the passage 46 and is biassed by means of a spring 76 to its projected position.

Figure 5:
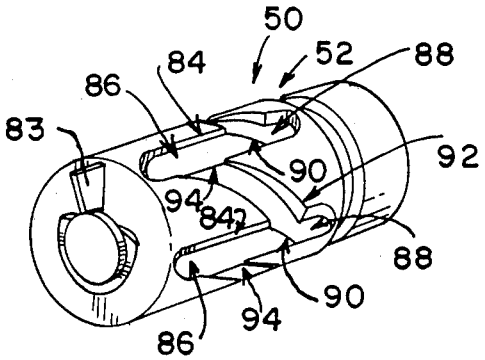
FIG. 5 shows, in three dimensional view at yet a larger scale the hammer of FIG. 4.

With reference also to FIG. 5 the grooves 52 in the periphery of the drum 50 comprise four interleading pairs of grooves, which are circumferentially spaced and which are respectively associated with the barrels 16. Each pair comprises a longitudinal groove 84 parallel to the axis of the hammer 49 to be parallel to the centre axis 48 when assembled. The groove 84 has a fore end portion 86 and a rear end portion 88. When the hammer 49 is cocked, i.e. when it is in a rearward position, the male projection 58 is laterally located in the fore portion 86. When the hammer 49 is released to move forward under its bias to fire a cartridge, the male projection 58 slides along the groove 84 to the rear end portion 88. The rear end portion 88 is stepped as indicated at 90 to be lower than the rest of the groove 84.

The second of each pair of grooves is an oblique groove 92 extending, from immediately forward of the rear portion 88, transversely and forwardly. The step 90 which is oblique defines the boundary between the groove 84 and the groove 92 which is deeper than the groove 84 and acts to guide the male projection along the groove 92 rather than along the groove 84. The male projection pivots the drum 50 accordingly. The groove 92 becomes progressively shallower until it leads into the groove 84 of a succeeding pair. Where it leads into the succeeding groove 84, it is shallower than that groove 84. It leads into the groove 84 immediately rearward of the forward portion 86 of the groove 84. When the hammer is cocked again, the procedure described above is repeated. A step 94 guides the male formation 58 rearward along the longitudinal groove 84 rather than along the oblique groove 92.

The base 51 of the hammer 49 has a circumferential shoulder 72, the significance of which is described hereinafter.

Figure 6:
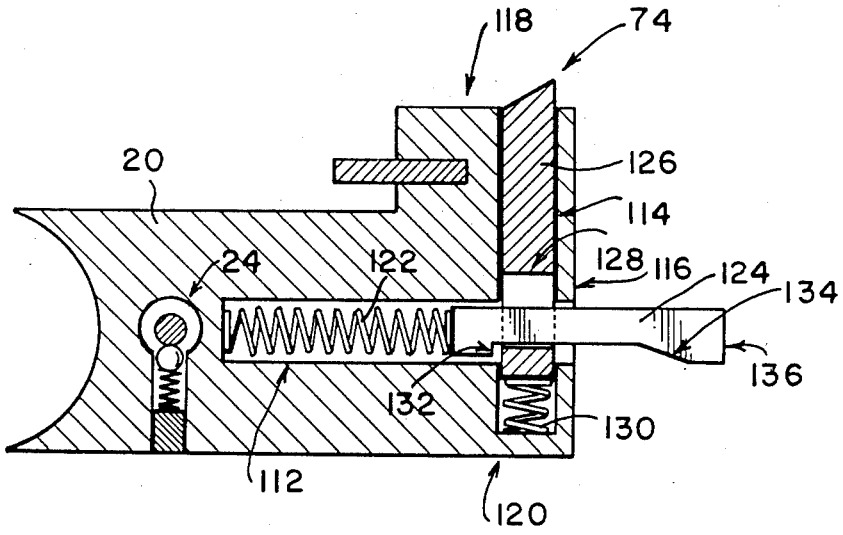
FIG. 6 shows, in sectional side view, to a larger scale a trigger and cocking mechanism of the firearm of FIG. 1.

With reference more specifically to FIGS. 3 and 6, a socket 112 is provided in the trigger 20 from a rear face 116. The socket 112 is arranged, when the trigger 20 is assembled in the frame 12, to be parallel to the centre axis 48.

Toward the rear of the trigger 20, there is provided a socket 114 perpendicular to the socket 112 and extending into the trigger from its upper face 118. The socket 114 intersects the socket 112.

The socket 112 accommodates a coil spring 122 and a ramp member 124. In its bottom, the ramp member has a recess defining toward its fore end and facing rearwardly a shoulder 132, and toward its rear end and facing downwardly and forwardly, an oblique ramp 134. The ramp member 124 has a rear face 136 which, in use, abuts a wall 138 of a firing mechanism cavity in the frame 12.

The socket 114 accommodates a coil spring 130 and a sear member 126. The sear member 126 has, toward its bottom end, a through aperture 128 adapted to pass the ramp member 124 with clearance. The sear member 126 has an upper end slanting upwardly and rearwardly. At an upward rear corner thereof there is defined a sear face 74.

To assemble the ramp member 124 and the sear member 126 in the trigger 20, the coil springs 122 and 130 are dropped into the sockets 112 and 114 respectively. The sear member 126 is then placed in the socket 114 and it is urged downwardly against the bias of the spring 130 to align its aperture 128 with the mouth of the socket 112. The ramp member 124 is then passed into the socket 112 and through the aperture 128. It is urged inwardly to compress the spring 122 until the shoulder 132 clears the passage 128. When both the sear member 126 and the ramp member 124 are released, the bias of the springs 122 and 130 on their members, ensure that the shoulder 132 abuts the side of the sear member 126 adjacent the aperture 128. The members 124 and 126 thus interlock each other within their sockets. In that position, the sear face 74 stands proud of the upper face 118 of the trigger 20. Also, the ramp member 124 stands well clear of the rear face 116 of the trigger 20 such that the ramp 134 is exposed.

When the trigger 20, with the members 124 and 126 in their sockets, are assembled in the frame 12, the rear 136 of the ramp member 124 abuts the wall 138 of the firing mechanism cavity. The upper slanted corner of the sear member 126 enters a groove in the hammer 49 between the drum 50 and the base 51 such that the sear face 74 abuts the shoulder 72.

When the trigger 20 is depressed, the ramp member 124 retains its position relative to the frame owing to its rear 136 abutting the wall 138. The sear member 126 is displaced with the trigger 20. The sear face 74 urges the hammer 49 rearwardly which is allowed by the male member 58 sliding along one of the longitudinal grooves 84 as described above. When the trigger 20 has been depressed a predetermined distance, the ramp 134 commences engaging the sear member 126 at the boundary of the aperture 128. Further depression of the trigger 20 displaces the sear member 126 progressively downwardly until the sear face 74 is slid out of engagement with the shoulder 72 thus allowing the hammer 49 to be propelled forward under the bias of the spring 64 to fire a shot.

When the trigger is released, the spring 122 urges the trigger forward to its rest position. In its rest position, the sear member 126 is aligned with the groove in the hammer 49 to allow the sear face 74 to slide into engagement with the shoulder 72. The pistol 10 is then ready to fire another shot.

It is to be appreciated that neither the trigger 20, nor any of the members 124 or 126 is pivoted during cocking and firing. All movements are purely translational. Furthermore, in respect of the hammer 49, its motion during firing is purely translational. The drum 50 pivots about its own axis only during cocking to index it with a succeeding barrel 16. It is believed that this construction greatly facilitates manufacture of the firearm. It is a very simple construction which is inexpensive to manufacture and which, it is believed, will give reliable service.

Another feature which is to be appreciated is that the firing mechanism comprising the hammer assembly and the trigger assembly can be dismantled by merely removing the retaining pins 60 and 68, respectively to dismantle the guide member 56 and the hammer assembly. Thus, no tools apart from a slender prong such as a pin, a piece of wire, or the like (to remove the pins 60, 68) is required.

What is claimed is:

1. A firearm including a plurality of barrels circumferentially spaced about a centre axis, the axes of the barrels being substantially parallel to one another and to said centre axis, and a firing mechanism having a trigger;

a hammer mounted for translation in forward/rearward directions between a cocked position and a fire position and for pivoting about a hammer pivot axis co-axial with said centre axis, and which is resiliently biassed to its fire position;

a striking formation fast with the hammer and transversely spaced from the hammer pivot axis in correspondence with the spacing of the barrels from the centre axis;

pivot means adapted to pivot the hammer about said hammer pivot axis between shots to advance the striking formation from one barrel to another; and means for cocking and releasing the hammer which means is operatively connected to the trigger and which includes a sear located for displacement between an engaging position in which it engages the hammer and a release position in which it releases the hammer from its cocked position, and a ramp member having a ramp which is arranged, on depression of the trigger beyond a predetermined limit, to cause displacement of the sear to its release position.

2. A firearm as claimed in claim 1 which is adapted for use with rim fire cartridges, the striking formation being arranged to be off-set from the hammer pivot axis by a predetermined amount which is less than the spacing between the hammer pivot axis and the barrel axes.

3. A firearm as claimed in claim 1 in which the hammer is generally cylindrical and of composite construction including a drum and a base mounting the drum for rotation about said centre axis, the fire arm defining a corresponding cylindrical hammer passage having an axis co-axial with the centre axis and being adapted to locate the hammer to allow it to slide longitudinally along, and to rotate about, the centre axis.

4. A firearm as claimed in claim 3 in which the pivot means includes a plurality of sets of grooves in the drum which grooves are interconnected in series, each set of grooves being associated with a barrel and comprising two grooves extending generally longitudinal with the drum and at least one of said two grooves extending obliquely longitudinal in correspondence with the angular spacing of adjacent barrels; and a male formation adapted for sliding receipt in the grooves, and located in a frame of the firearm to guide the drum via the grooves.

5. A firearm as claimed in claim 4 in which the grooves are stepped at their intersections to allow relative sliding of the male formation in one direction only, the male formation being resiliently biassed to maintain engagement with the grooves.

6. A firearm as claimed in claim 1 in which the trigger is guided for translation parallel to the centre axis;

the sear is located on the trigger for movement generally with the trigger, said locating of the sear on the trigger being adapted to allow displacement of the sear relative to the trigger between said engaging position and said release position in a direction transverse to the centre axis; and the ramp formation is stationary.

7. A firearm as claimed in claim 6 in which the trigger has a guide passage arranged to be transverse to the centre axis in use, the sear being slidably located in said guide passage.

8. A firearm as claimed in claim 7 in which resilient bias means is provided in said guide passage adapted resiliently to bias the sear to its engaging position.

9. A firearm as claimed in claim 7 in which said guide passage is a sear guide passage, the trigger also having a ramp member guide passage which is arranged to be parallel to the centre axis in use, which intersects the sear guide passage, which is open ended at a rear face of the trigger and which is adapted slidingly to receive a fore end portion of the ramp member, the sear having a passage, arranged to allow passage to the ramp member, and a shoulder adjacent the passage and arranged for engagement by the ramp in use.

* * * * *